US007878328B2

(12) United States Patent
Dubosq et al.

(10) Patent No.: US 7,878,328 B2
(45) Date of Patent: Feb. 1, 2011

(54) PACK INCLUDING A FLANGE WHICH PARTIALLY COVERS A GROUP OF ARTICLES

(75) Inventors: Valérie Dubosq, Octeville-sur-Mer (FR); François Gosset, Octeville-sur-Mer (FR); Jean-Félix Lesueur, Octeville-sur-Mer (FR); Cyril Touchet, Octeville-sur-Mer (FR)

(73) Assignee: Sidel Participations, Octeville-sur-Mer (FR)

( * ) Notice: Subject to any disclaimer, the term of this patent is extended or adjusted under 35 U.S.C. 154(b) by 273 days.

(21) Appl. No.: 12/095,289

(22) PCT Filed: Nov. 27, 2006

(86) PCT No.: PCT/FR2006/002594

§ 371 (c)(1),
(2), (4) Date: May 28, 2008

(87) PCT Pub. No.: WO2007/060338

PCT Pub. Date: May 31, 2007

(65) Prior Publication Data

US 2008/0264818 A1 Oct. 30, 2008

(30) Foreign Application Priority Data

Nov. 28, 2005 (FR) ..... 05 12033

(51) Int. Cl.
*B65D 71/50* (2006.01)
*B65D 71/06* (2006.01)

(52) U.S. Cl. ..... 206/432; 206/497; 206/427

(58) Field of Classification Search ..... 206/432, 206/427, 428, 429, 497, 139, 192, 434, 433; D9/751, 752

See application file for complete search history.

(56) References Cited

U.S. PATENT DOCUMENTS 3,031,359 A * 4/1962 Blank et al. ..... 229/117.26
3,118,537 A * 1/1964 Copping ..... 206/153
3,217,874 A * 11/1965 Potter ..... 206/432
3,525,428 A * 8/1970 Stephan ..... 206/432

(Continued)

FOREIGN PATENT DOCUMENTS

GB 1 299 116 A 12/1972

(Continued)

*Primary Examiner*—Mickey Yu
*Assistant Examiner*—Steven A. Reynolds
(74) *Attorney, Agent, or Firm*—Sughrue Mion, PLLC

(57) ABSTRACT

The invention relates to a packet (1) including: a group of articles (2) which are arranged in several rows (4, 5, 6, 7) which each contain at least two adjacent articles (2), including a first row (4) at the front end (3) of the packet (1), each article (2) having a base (9) and an opposing top (10); a side (16) which is made from a rigid or semi-rigid material, which is disposed on the articles (2) and which includes an upper panel (17) that covers the tops (10) of at least one row (5, 6, 7) of articles (2); and a film (19) which is wrapped tightly around the assembly. The aforementioned upper panel (17) of the side (16) covers the tops (10) of the articles (2) in all of the rows (5, 6, 7) with the exception of the tops (10) of the articles (2) in the first row (4).

14 Claims, 6 Drawing Sheets

U.S. PATENT DOCUMENTS 3,552,559 A 1/1971 Kirby, Jr.
3,674,136 A * 7/1972 Forrer ..... 206/153
3,693,787 A 9/1972 Duerr
3,712,464 A * 1/1973 Chapman et al. ..... 206/432
4,375,258 A * 3/1983 Crayne et al. ..... 206/141
5,079,900 A * 1/1992 Pinckney et al. ..... 53/413
5,505,304 A * 4/1996 Broskow et al. ..... 206/427
5,538,133 A * 7/1996 Campbell et al. ..... 206/427
5,876,081 A * 3/1999 Melody et al. ..... 294/27.1
6,050,058 A * 4/2000 Loreto et al. ..... 53/411

FOREIGN PATENT DOCUMENTS

WO 95/07848 A1 3/1995

* cited by examiner

PACK INCLUDING A FLANGE WHICH PARTIALLY COVERS A GROUP OF ARTICLES

FIELD OF THE INVENTION

The invention relates to the packaging of articles. More specifically, the invention relates to packs in which the articles are held grouped together by means of a film tightly wrapped around said articles.

BACKGROUND OF THE INVENTION

This type of pack is commonly encountered in the agri-food industry, in particular for packaging bottles or beverage cans.

A standard pack comprises a group of articles wrapped in a heat-shrunk plastics film. A group of articles such as bottles has numerous raised portions and hollow spaces. Due to its elasticity, the film clings to the projections and partially fills the hollow spaces between the articles. This characteristic of the film makes it possible to ensure good stability of the group of articles, in particular during the various handling procedures to which the pack is subjected.

Nevertheless, this elasticity proves to be a drawback when the articles are unwrapped: it is necessary to tear the film to gain access to the first articles, then to tear it further to gain access to the subsequent articles.

A proposed solution to this problem is disclosed in the European patent EP 717 712, which describes a pack containing a group of bottles enclosed in a heat-shrunk plastics film, provided with precut lines arranged between two successive rows of bottles, to allow the easy opening of the pack and the separation of the rows of bottles.

However, as the bottles are removed from the pack in pairs, with a residue of film tightly wrapped around each pair removed, to gain access to the articles of each pair removed it is necessary systematically to tear the remaining film. This solution to the problem disclosed above is therefore only partial.

SUMMARY OF THE INVENTION

The object of the invention is to propose an alternative solution which facilitates the removal of the articles from a pack wrapped in film.

To this end, according to the first of its features, the invention proposes a pack comprising:

- a group of articles arranged in a plurality of rows each composed of at least two adjacent articles, including a first row located at one front end of the pack, each article having a base and a top which are opposed;
- a flange made of a rigid or semi-rigid material, arranged on the articles and comprising an upper panel covering the tops of at least one row of articles; and
- a film tightly wrapped around the assembly; which pack is characterized according to the invention in that said upper panel of the flange covers the tops of the articles of all the rows with the exception of the tops of the articles of the first row.

The flange avoids the formation of depressions in the film between the covered articles and facilitates the removal thereof; the fact that it allows the articles of the first row to be uncovered facilitates the removal thereof by simply tearing the film, which proves most particularly advantageous when the articles are containers.

According to a preferred embodiment, the flange comprises two lateral panels folded back against the articles and which cover laterally an upper part thereof, said upper part being able to be flared from the top toward the base.

Moreover, the lateral panels preferably have projections which cover, at least partially, the articles of the first row at the sides.

Regarding the film, it is preferably provided with a precut portion which extends between the first row and the adjacent row, following at least in places, a front edge of the flange.

According to one embodiment, the flange is made of cardboard, of which the grammage is greater than 280 gsm and for example 320 g/sm or 380 g/sm approximately.

Moreover, the flange may have two foldable flaps made in the upper panel, defined by cutouts having a concavity facing a rear end of the pack, opposing the front end.

According to one particular embodiment, the pack comprises eight articles grouped in four rows of two articles each. The articles are, for example, containers, and in particular bottles.

According to the second of its features, the invention proposes a pack comprising:

- a group of at least two articles, each having an opposing base and top;
- a flange made of a rigid or semi-rigid material and covering the top of at least one of the articles; and
- a film tightly wrapped around the assembly; characterized in that the flange covers the top of one of the articles, leaving the top of the other article uncovered.

BRIEF DESCRIPTION OF THE DRAWINGS

Further subjects and advantages of the invention will become apparent by reading the following description with reference to the accompanying drawings, in which.

DETAILED DESCRIPTION OF THE INVENTION

Figure 1:
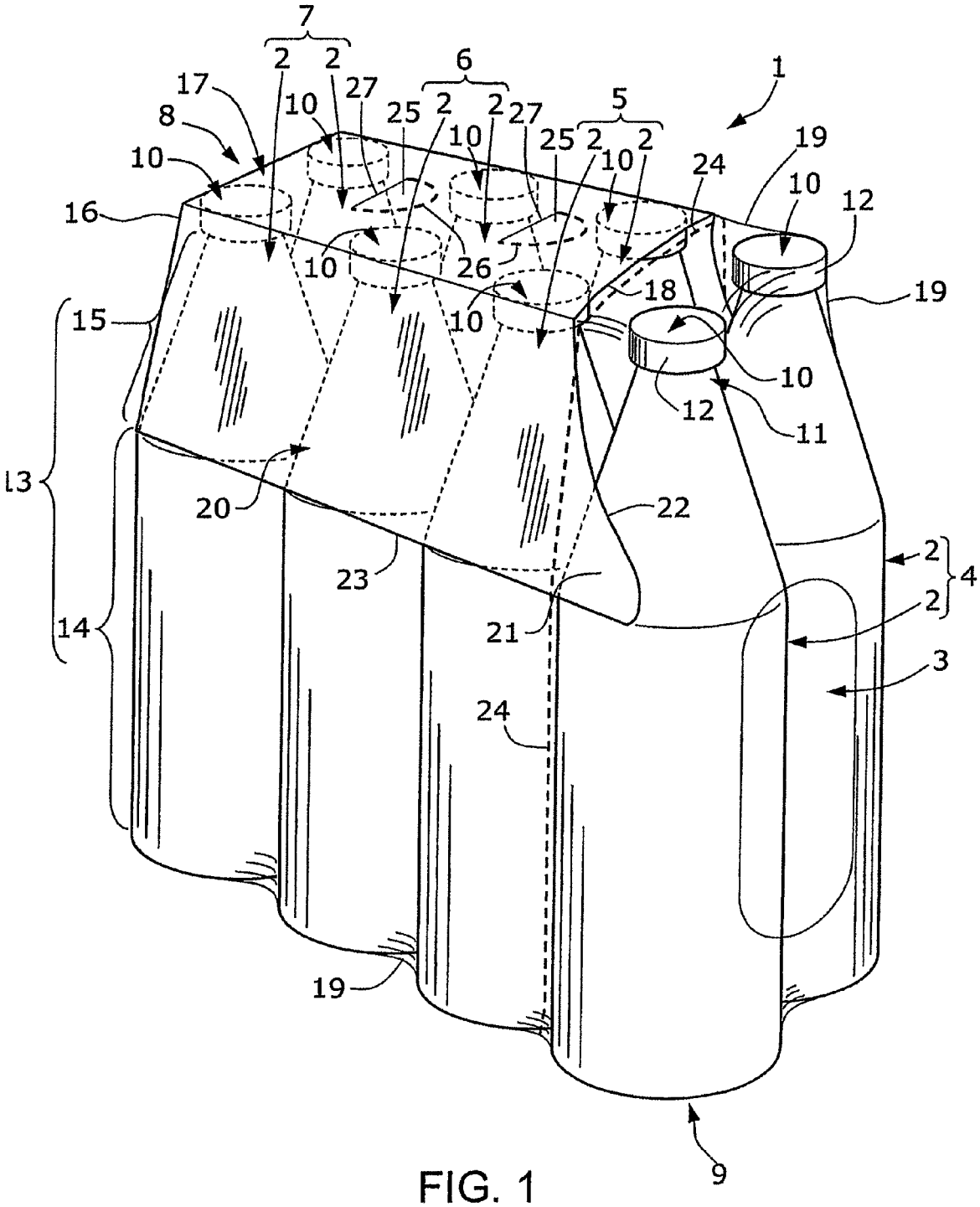
FIG. 1 is a perspective view of a pack of articles according to the invention.

In FIG. 1 is shown a pack 1. Said pack 1 comprises a plurality of articles 2 (here, containers such as bottles or flasks) in this case eight in number, grouped in rows of two adjacent articles 2.

In the remainder of the description, the reference 2 will be used both to denote the articles or containers.

Departing from one front end 3 of the pack 1, the row 4 of articles 2 located at the front end 3 is denoted the first row, and successively, the following rows as far as one rear end 8 of the pack 1 are denoted second row 5, third row 6 and fourth row 7, opposing the front end 3 and where the fourth row 7 is located.

Each article, when it consists of a container 2, such as a bottle or flask, has:

- a base 9,
- a top 10 opposing the base 9 and defined by a neck 11 surmounted by a cap 12,
- a lateral wall 13 comprising a substantially cylindrical lower part 14, known as the body, and a flared upper part 15 (in this case truncated, the base of the truncated cone being located at its join with the body 14) known as the shoulder which connects the top 10 to the body 14.

As is visible in FIG. 1, the pack 1 further comprises a flange 16 made of a rigid or semi-rigid material and comprising a substantially planar upper panel 17 which covers the tops 10 of the containers 2 of the second, third and fourth rows 5, 6, 7 by leaving the tops 10 of the containers 2 of the first row 4 uncovered, one front edge 18 of the upper panel 17 extending between the tops 10 of the containers 2 of the first row 4 and those of the second row 5, substantially parallel thereto.

The flange 16 is preferably made of cardboard, of a grammage preferably greater than 280 gsm. According to one particular embodiment, the grammage of the cardboard is 320 gsm; it may also be 380 gsm. As a variant, the flange 16 may be made of a plastics material such as polypropylene.

The pack 1 finally comprises a film 19 tightly wrapped around the whole assembly, i.e. the containers 2 and the flange 16 together. In this case it is a heat-shrunk plastics film (such as polyethylene), which in the parts of the containers 2 not covered by the flange 16 substantially follows the shapes of the containers 2 (in particular in the region of the body 14 and the base 9), but which in the region of the top 10 of the containers 2, on the covered rows 5, 6, 7, extends within the plane of the flange 16.

In this manner, once the part of the film 19 which is tightly wrapped around the first row 4 of containers 2 is torn, and after having removed said containers, access is easily gained to the containers 2 of the subsequent rows 5, 6, 7 of which the removal is facilitated by the presence of the flange 16. More specifically, the flange 16 achieves the double function of preventing the film 19 from filling up, even partially, the hollow spaces between the tops 10 of the containers 2, and, as a result of the smooth appearance of its internal face (i.e. the face turned toward the containers 2), of not resisting the removal of the containers 2.

On the contrary, in the case of solely a heat-shrunk film enclosing a group of articles, not only the depressions in the film resist the removal thereof, but the film has, moreover, the tendency to adhere to the surfaces with which it is in contact. Moreover, in the other particular case of a pack comprising a flange made of cardboard surmounting the articles but provided with means for wedging said articles formed, for example, by folds or cutouts (see for example the US patent Chapman No. U.S. Pat. No. 3,747,750) said wedging means also resist the removal of the articles, since it is necessary to tear the flange.

It is understood, therefore, that in this particular case the flange 16 and the film 19 have, in contrast in particular to the packs of the type disclosed in Chapman, contradictory functions: the film 19 aims to ensure the tight cohesion of the group of articles 2, whilst the flange 16 aims in contrast to facilitate the movement of the articles 2 relative to the others.

It is possible, moreover, to facilitate further the removal of the articles, when said articles are containers 2, from the covered rows 5, 6, 7, by additionally covering at least partially the side wall 13 of the containers 2.

Thus, according to a preferred embodiment illustrated in the figures, the flange 16 comprises, on both sides of the upper panel 17, two lateral panels 20 folded back against the lateral walls 13 of the containers 2 and which extend over part of the height thereof, for example, as in this case, so as to cover the shoulder 15.

This arrangement further facilitates the removal of the containers 2 from the second, third and fourth rows 5, 6, 7 by avoiding the formation of depressions in the film 19 in the region of the shoulders 15 between the containers 2 of two adjacent rows.

Moreover, as is visible in FIGS. 1 to 5 in particular, each lateral panel 20 has a substantially trapezoidal shape, and has a projection 21 defined by a front oblique edge 22 and which in the vicinity of a lower edge 23 of the lateral panel 20 partially covers the shoulder 15 of the container 2 of the first row 4, at the join between the shoulder 15 and the body 14.

In this manner, the lateral panel 20 avoids the formation of a depression in the film 19 in the region of the shoulders 15 between the containers 2 of the first row 4 and those of the second row 5, which facilitates the removal of the containers 2 from both rows equally.

Moreover, as is also visible in FIGS. 1 to 5, the film 19 is provided with a precut portion 24 which extends between the containers 2 of the first row 4 and those of the second row 5. As is visible in FIG. 1, this precut portion 24 forms a line which, in places, extends along the front edge 18 of the upper panel 17, joining it to the side of the front end 3 of the pack 1.

Figure 4:
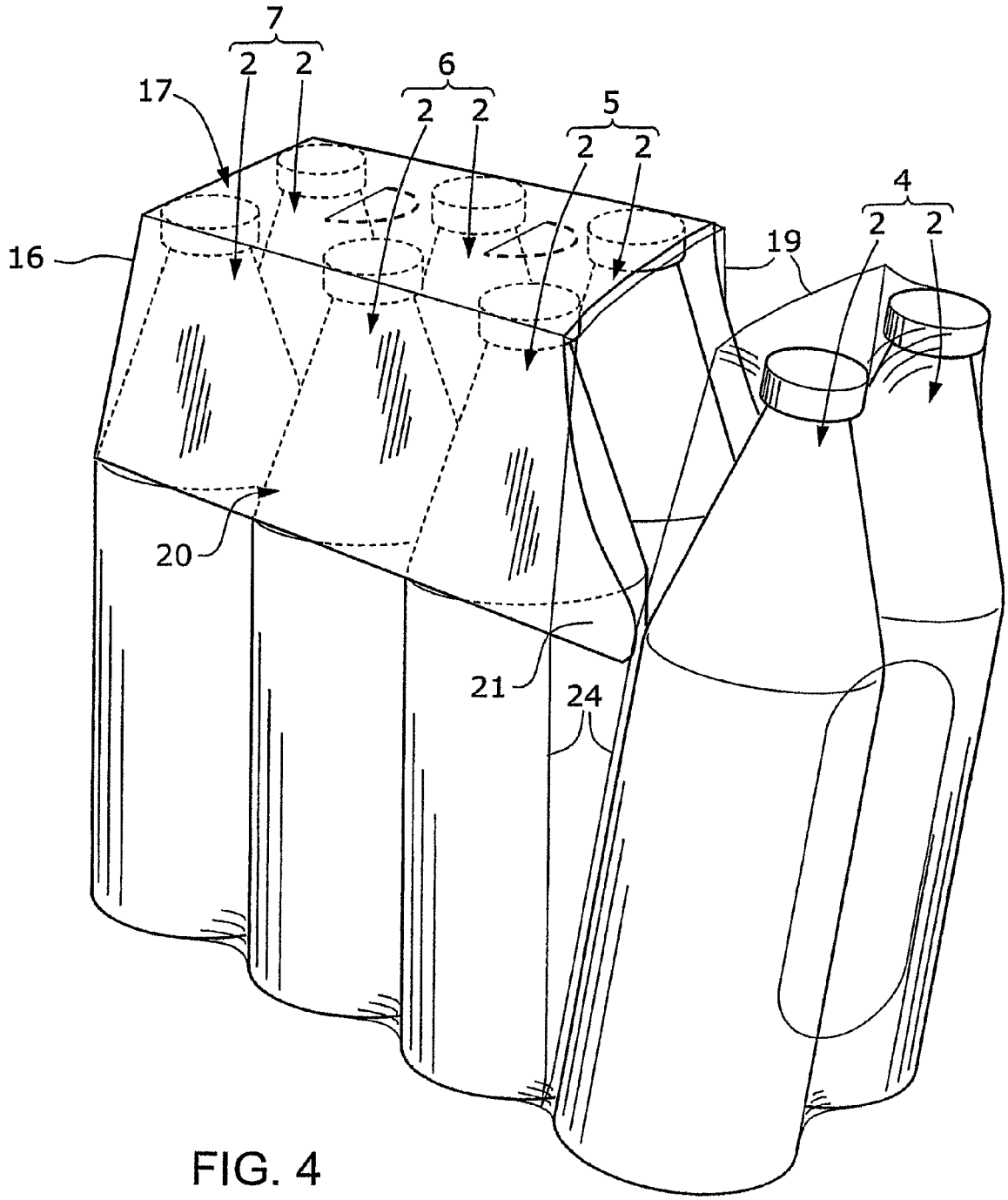
FIGS. 4 and 5 are views similar to FIG. 1, which illustrate the opening of the pack and the removal of articles therefrom.

This precut portion 24 aims to facilitate the opening of the pack 1 for the removal of the containers 2 of the first row 4. It is possible merely to tear the part of the film 19 covering the containers 2 of the first row 4, but it will be more easily torn simply by pulling on the containers 2, as is shown in FIG. 4.

Figure 5:
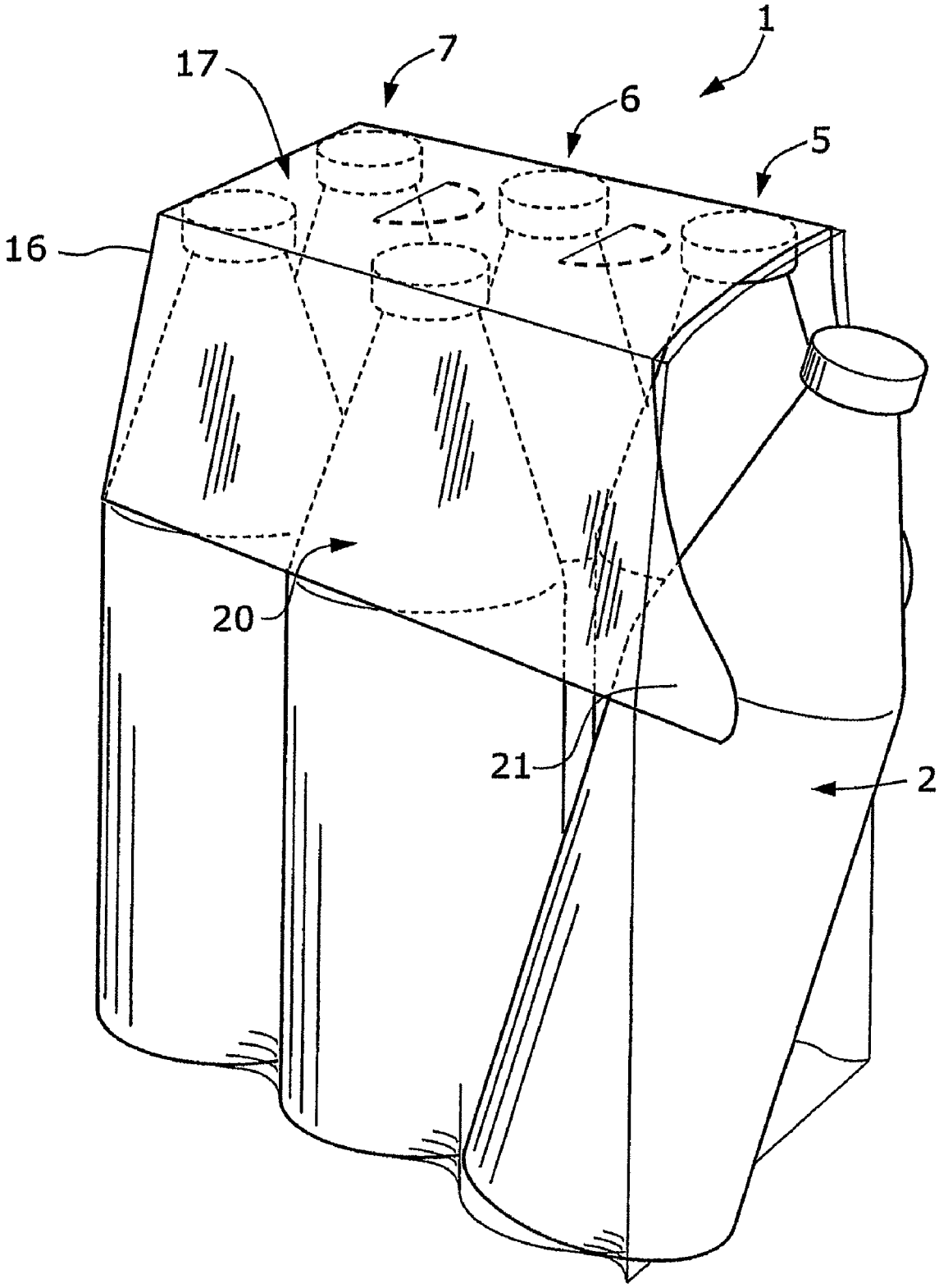
Figure 7:
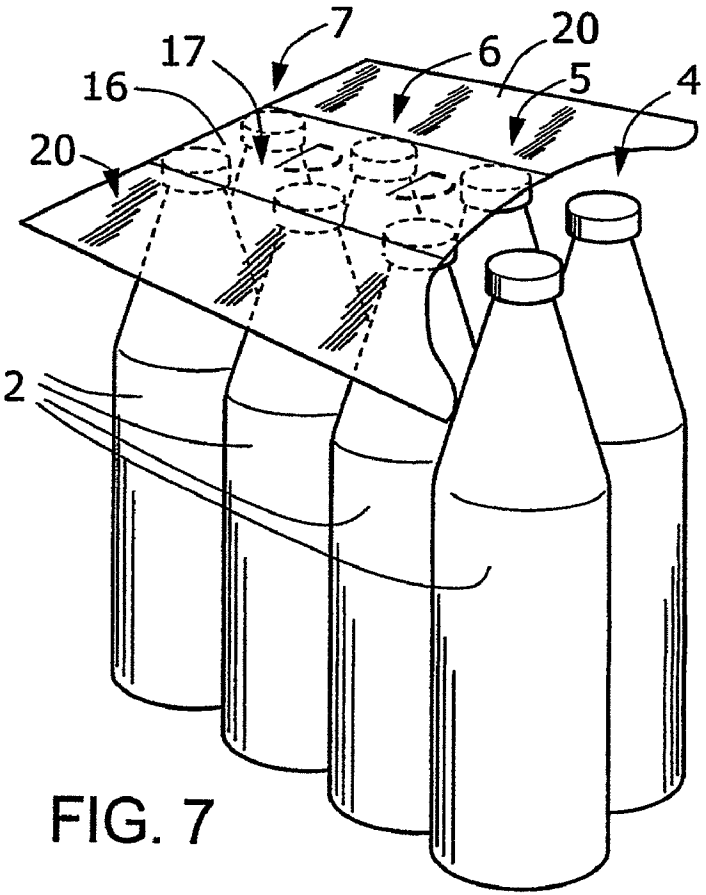
FIGS. 6, 7, 8 and 9 are views illustrating the steps of a method of manufacturing the pack.
Figure 6:
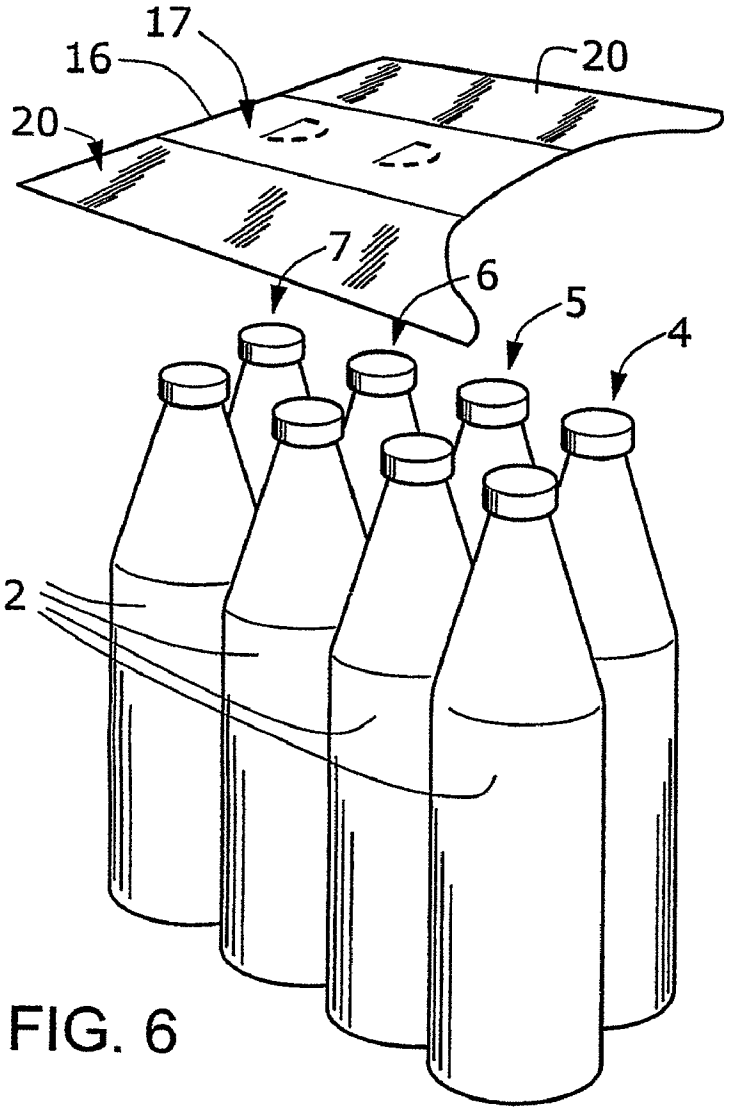
Figure 9:
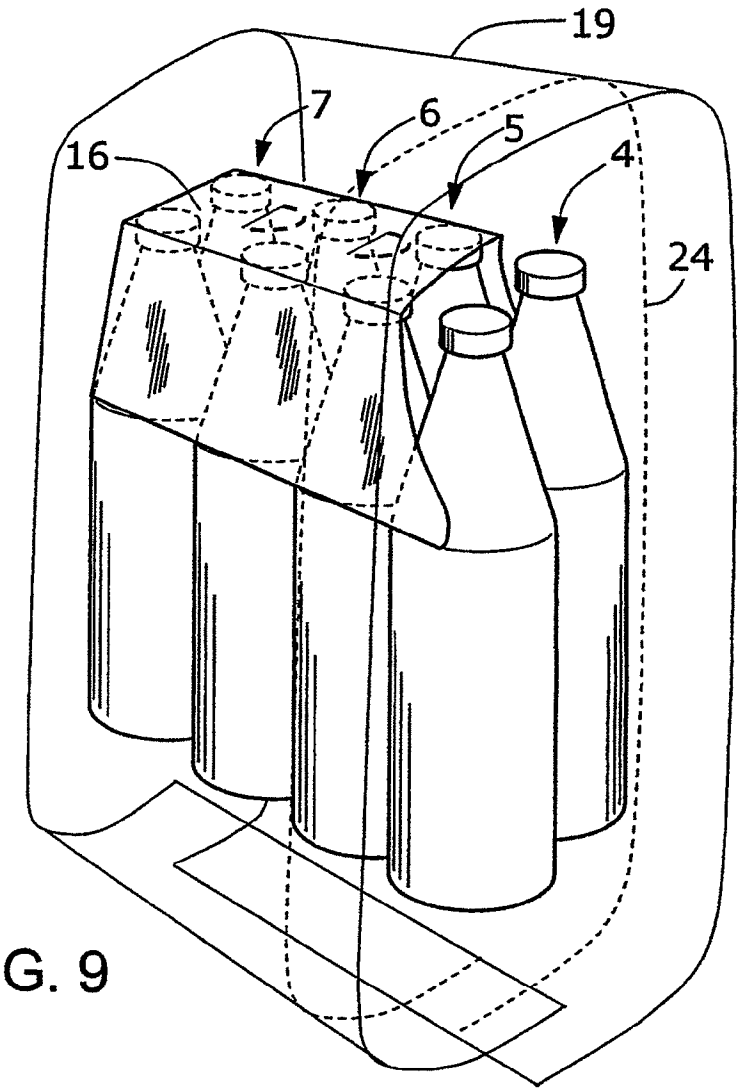
Figure 8:
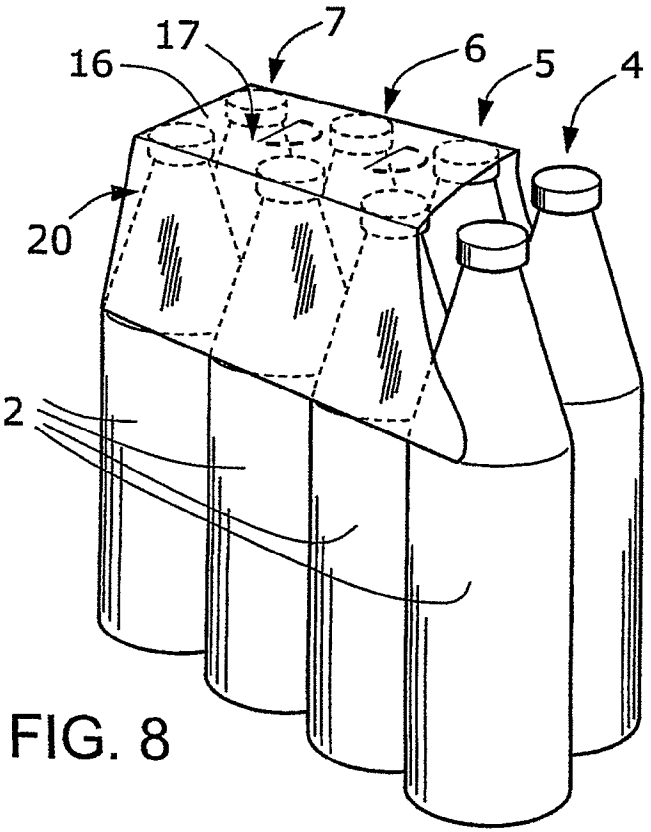

The containers 2 of the following rows 5, 6, 7 (covered by the flange 16) are then removed by being grasped by their neck 11 or even by their shoulder 15, then tilted forward without forcing, as shown in FIG. 5.

Figure 2:
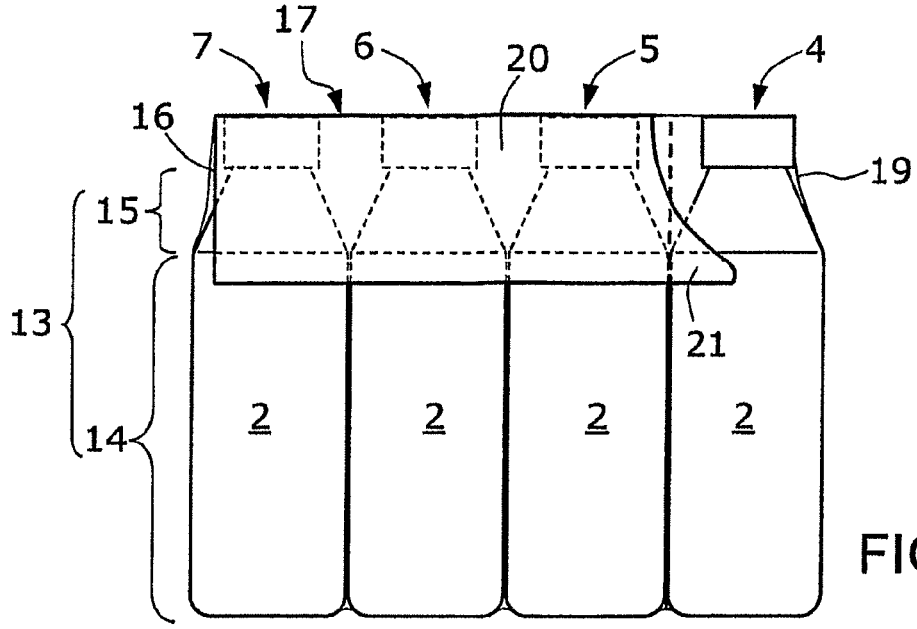
FIG. 2 is a side elevation of the pack of FIG. 1.
Figure 3:
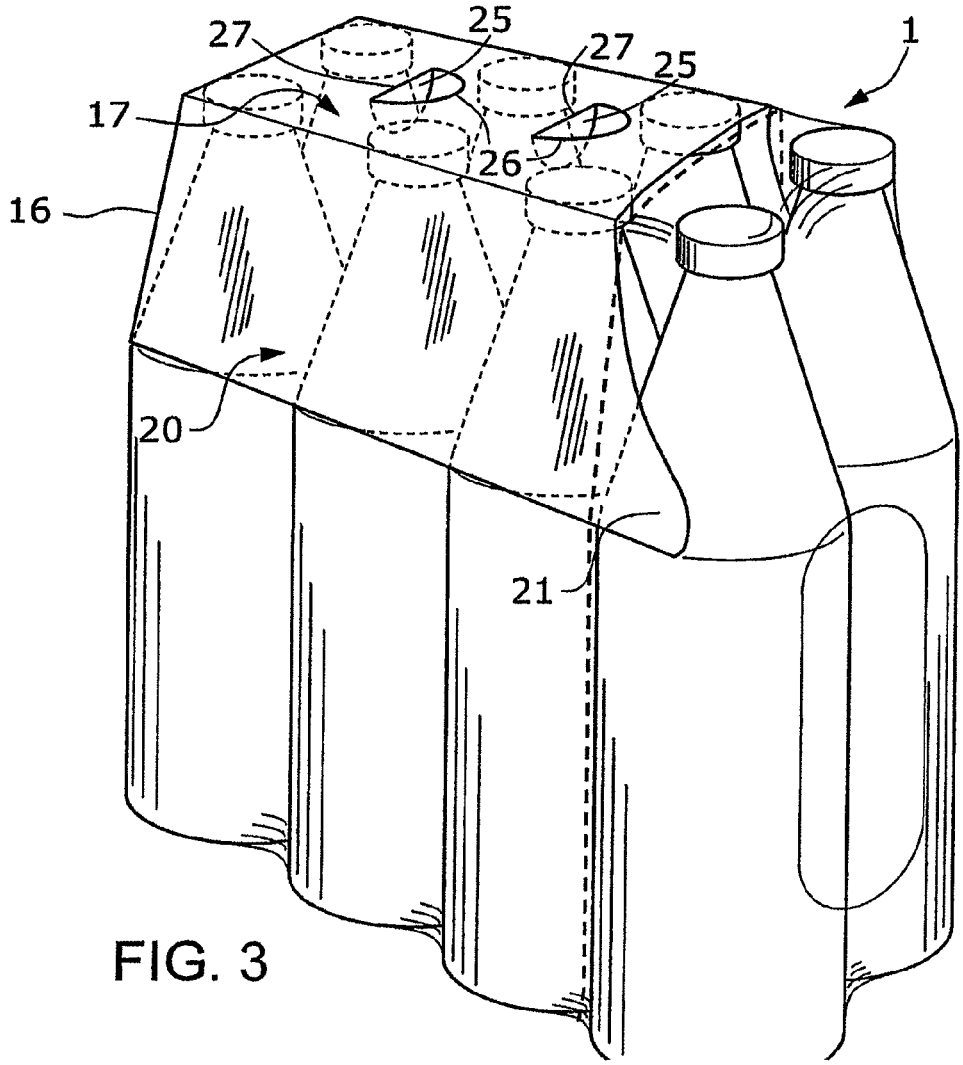
FIG. 3 is a view similar to FIG. 1, in which the means for manually gripping the pack are in a different configuration.

Moreover, as is visible in particular in FIGS. 1 to 3, the flange 16 has two frangible half-moon-shaped flaps 25, each defined by a semi-circular cutout 26. A first flap is formed between the second row 5 and the third row 6, the second being formed between the third row 6 and the fourth 7. Under pressure exerted by the fingers of a user (for example the index and the middle finger) the flaps 25 are folded back inside the pack 1 by folding around a fold line 27 joining the ends diametrically opposing the cutouts 26 (FIG. 3) which facilitates the gripping thereof, for example for its removal from a supermarket shelving unit.

The concavity of both cutouts 26 faces toward the rear, such that even after the flaps 25 have been folded back, said flaps do not prevent the removal of the containers 2 from the third row 6 or from the fourth row 7 and, under the pressure of the containers 2, are simply pushed forward by being folded around their fold line 27.

Although the articles 2 of the pack 1 which have been disclosed above are containers, they could be any other type of articles: cans, beverage cans, glass containers, jars.

Moreover, the configuration of the pack 1 which has been disclosed above (namely four rows 4, 5, 6, 7 of two containers 2 each) corresponds to a conventional configuration encountered frequently on supermarket shelves, especially for bottles of small volume (in particular bottles of 0.5 l). However, any other configuration could be suitable (for example six articles grouped in rows of two, or nine articles grouped in rows of three), the minimum conditions required, however, being that the pack comprises at least two articles, of which a first article is left uncovered to the side and the second is covered thereby.

Now a method is described for manufacturing the pack 1 disclosed above, referring to FIGS. 6 to 9.

Firstly, the containers 2 are grouped together according to the required configuration (in this case four rows of two containers each). Then above the containers 2, the flange 16 is positioned flat, the upper panel 17 (which is the central panel of the flattened flange 16) covering the tops 10 of the containers 2 of the second, third and fourth rows 5, 6, 7. Then the lateral panels 20 are folded back against the shoulders 15 of the containers 2. Then the assembly is wrapped in plastics film 19 originating from a drum such that the covering with film 19 is carried out from the side of the bases 9 of the containers 2 (see FIG. 9). The film 19 is precut along a continuous line parallel to one of its lateral edges, the positioning of the film 19 being such that the precut portion 24 is positioned between the first row 4 and the second row 5. The assembly finally passes through a tunnel oven (not shown) where the film 19 is heat-shrunk to wrap the containers 2 and the flange 16 tightly together which is thus fixedly held in place.

The method which has been disclosed above may, in particular, be implemented in a conventional shrink wrapping machine (such as the sealless shrink wrapping machine proposed by the CERMEX company under the brand name TS EVOLUTION 3), to which a station for supplying flat sides might be added and, if required, a station for folding the sides around the containers.

The invention claimed is:

1. A pack comprising:

a group of articles arranged in a plurality of rows each composed of at least two adjacent articles, including a first row located at one front end of the pack, each article having an opposing base and top;

a flange made of a rigid or semi-rigid material, arranged on the articles and comprising an upper panel covering the tops of at least one row of articles, the group of articles and the flange forming an assembly; and a film tightly wrapped around the whole assembly;

wherein said upper panel of the flange covers the tops of the articles of all the rows with the exception of the tops of the articles of the first row, said plurality of rows comprising at least three rows.

2. The pack as claimed in claim 1, wherein said flange comprises two lateral panels folded back against the articles and which cover laterally an upper part thereof

3. The pack as claimed in claim 2, wherein said upper parts of the articles covered by the lateral panels are flared.

4. The pack as claimed in claim 2, wherein said lateral panels have projections which cover, at least partially, the articles of the first row at the sides.

5. The pack as claimed in claim 1, wherein said film is provided with a precut portion which extends between the first row and the adjacent row.

6. The pack as claimed in claim 5, wherein said precut portion follows, at least in places, a front edge of the flange.

7. The pack as claimed in claim 1, wherein said flange is made of cardboard.

8. The pack as claimed in claim 7, wherein said cardboard has a grammage of greater than 280 gsm.

9. The pack as claimed in claim 8, wherein said cardboard has a grammage of 320 gsm.

10. The pack as claimed in claim 8, wherein said cardboard has a grammage of 380 gsm.

11. The pack as claimed in claim 1, wherein said flange has two foldable flaps formed in the upper panel, defined by cutouts having a concavity facing a rear end of the pack, opposing the front end.

12. The pack as claimed in claim 1, comprising eight articles grouped in four rows of two articles each.

13. The pack as claimed in claim 1, wherein said articles are containers.

14. The pack as claimed in claim 13, in which said containers are bottles.

* * * * *